United States Patent [19]

Bulson et al.

[11] Patent Number: 4,839,621

[45] Date of Patent: Jun. 13, 1989

[54] ELECTROMAGNETIC ACTUATOR HAVING IMPROVED DAMPENING MEANS

[75] Inventors: Laura G. Bulson; Laura P. Misenheimer; Robert A. Sebrosky, all of Charlotte, N.C.

[73] Assignee: International Business Machines Corporation, Armonk, N.Y.

[21] Appl. No.: 259,063

[22] Filed: Oct. 18, 1988

[51] Int. Cl.[4] ..... H01F 7/08

[52] U.S. Cl. ..... 335/277

[58] Field of Search ..... 335/257, 270, 277, 279

[56] References Cited

U.S. PATENT DOCUMENTS 3,675,172 7/1972 Petúsky ..... 335/277 X 4,272,748 6/1981 Fugate et al. ..... 335/277 X 4,749,976 6/1988 Pichler ..... 335/271 X

*Primary Examiner*—George Harris

*Attorney, Agent, or Firm*—Robert M. Chiaviello, Jr.

[57] ABSTRACT

A print mechanism has a laterally spaced longitudinally driven actuator or slider mounted between two electromagnets. By selective actuation of the electromagnets the slider is driven forward to strike a print element and produce printed information. A unique dampener assembly is provided to absorb recoil energy and maintain a fixed start position. The dampener assembly includes a return spring and a three layer damper that absorbs the excess recoil energy without experiencing permanent deformation.

6 Claims, 3 Drawing Sheets

ELECTROMAGNETIC ACTUATOR HAVING IMPROVED DAMPENING MEANS

TECHNICAL FIELD

This invention relates to linear actuators for use in impact printers and more particularly to dampeners for such actuators.

BACKGROUND OF THE INVENTION

In one known type of printer, adapted to print on a print medium as it passes over a platen using a plurality of print elements operated selectively by hammers, the print elements 10 are mounted on flexible fingers forming part of a metal band which is in the form of a continuous loop, one print element being mounted on each flexible finger. The print elements extend in a straight line along the band parallel to the longitudinal center line of the band. A bank of hammers extends along the platen and is spaced from the platen so as to define a print region between the hammer bank and the platen. The print medium, such as a continuous web of paper, extends through the print region over the platen so that the hammer bank extends across the width of the print medium. The metal band on which the print elements are mounted also extends through the print region along the platen and across the width of the print medium and is located between the hammer bank and the print medium. An ink ribbon also is located in the print region between the metal band and the print medium.

The metal band is driven continuously past the platen and the hammer bank and across the print medium by a suitable drive system. Operation of any one of the hammers of the bank causes that hammer to move towards the metal band and to strike one of the print elements so as to move that print element on its flexible finger towards the ink ribbon and the print medium. The print element abuts against the ink ribbon, moves the ink ribbon into contact with the print medium and presses the ink ribbon and the print medium against the platen causing the printing of a mark on the print medium in the shape of the print element.

According to one particular printer of the above kind and illustrated by way of example in U.S. Pat. No. 4.428.284. each of the print elements is shaped like a dot and operation of each hammer causes the printing of a dot on the print medium. As the metal band moves continuously across the print medium, operation of selected hammers will result in the printing of a row of dots in positions on the print medium corresponding to the positions of the hammers which are operated. Each hammer is formed with a head having a width in the direction of movement of the band which is greater than the width of a single print element. It is therefore possible for each hammer to print a dot in any position on the print medium which is covered by the hammer by varying the timing of the operation of the hammer relative to the movement of the band. As a result, the dots in the row printed can occupy many selected positions on the print medium. There is only a small gap between each pair of adjacent hammer heads and the hammers can therefore print dots at all required positions along the row being printed.

After one row of dots has been printed the print medium can be moved through a small increment transversely to the length of the platen and the operation can be repeated resulting in the printing of a second row of dots spaced from the first row of dots. By repeating these operations rows of dots can be printed as required.

A character can be printed on the medium by printing dots in selected positions in a matrix, for example a matrix of five columns and seven rows. By printing dots in selected positions in rows as described above and selectively moving the print medium, characters can be printed in selected positions on the medium.

In the printer described above the hammers are mounted together to form a hammer bank which extends along the platen. Each hammer is formed with a head and is associated with a respective actuator which has a finite width. It is desirable for the heads of adjacent hammers to be spaced apart by only a small distance so as to be able to print dots substantially at all positions along a row on the print medium. With such an arrangement each hammer head will cover a plurality of positions in which dots are required to be printed and therefore each hammer will have to be operated a plurality of times in printing a row of dots. In order to reduce the number of times that each hammer will have to be operated in printing a row of dots, the width of each hammer must be reduced. This requires that the width of each hammer and actuator assembly must be reduced.

Various types of printer hammer actuator are known. One particular type with which the present invention is concerned is described by way of example in Canadian Pat. No. 1.135.317. The printer hammer actuator described is an electromagnetic actuator which includes a stator in two halves, each provided with a coil, and a moving armature member which is formed from a non-magnetizable material, for example a synthetic plastic material, and is flat with a rectangular cross section. The armature member is provided with a plurality of armature elements of magnetizable material. The armature elements are spaced apart along the length of the armature member. The armature member is provided with longitudinally extending ribs to add to its strength and to guide it during operation. A hammer head is formed at one end of the armature member.

The stator of the actuator is formed in two halves with pole pieces extending towards each other in pairs and spaced apart so as to form a set of gaps in which the armature member is located. When the armature member is in the rest position each of the armature elements in the armature member is slightly spaced from a respective one of the pairs of pole pieces of the stator. When the coils of the stator are energized, a flux is generated which flows between the pairs of pole pieces and through the armature elements. As a result each armature element is attracted to the adjacent pair of pole pieces and a longitudinal force is exerted on the armature member. The armature member is retained in its rest position by a spring. The longitudinal force causes the armature member to move against the action of this spring and allows the head on the armature to perform a printing operation.

SUMMARY OF THE INVENTION

In a print mechanism employing a linear actuator, printing is accomplished by selectively driving a slider to strike a print element. Print speed is determined by how fast a slider can be repetitively driven. This measure is commonly referred to as the rep rate and is determined by the time required to drive the slider forward, strike the print element and return to the start position. A graph of slider displacement as a function of time is shown in FIG. 5. The graph accurately depicts slider motion and illustrates that on the return stroke the slider goes beyond the start position, shown as the base line in the figure, with a certain amount of oscillation before damping out sufficiently enough to fire again. The time needed to damp is called settle out time and is shown as Ts in the graph.

Dampers are used to perform dual functions of (1) dissipating the excess energy of the slider and (2) establishing a repeatable start position. These two requirements are to an extent mutually exclusive: Elastic materials perform the best in absorbing energy while inelastic materials perform better at setting exact positioning.

Therefore, it is an objective of this invention to provide a dampener for a linear actuator that can rapidly absorb excess kinetic energy while at the same time maintaining a rigid fixed position. This and other advantages have been achieved by the present invention which relates to an electromagnetic actuator comprising an armature, a stator means and a dampening assembly. The armature has a face and a tail. The stator means has a core surrounded by a coil positioned adjacent to the armature for driving the armature in a forward direction when the coil is energized. The dampening assembly is positioned adjacent to the armature tail for absorbing the kinetic energy of the armature. The assembly further comprises a frame member. a two layer dampener fixed in said frame member and adjacent to the armature tail. The impact of the armature against the two layer dampener places the dampener in shear whereby the kinetic energy of the armature is transferred to the dampening assembly while maintaining a fixed start position.

BRIEF DESCRIPTION OF THE DRAWINGS

FIG. is a side view of a linear actuator according to the present invention.

DETAILED DESCRIPTION OF THE PREFERRED EMBODIMENT

Figure 1:
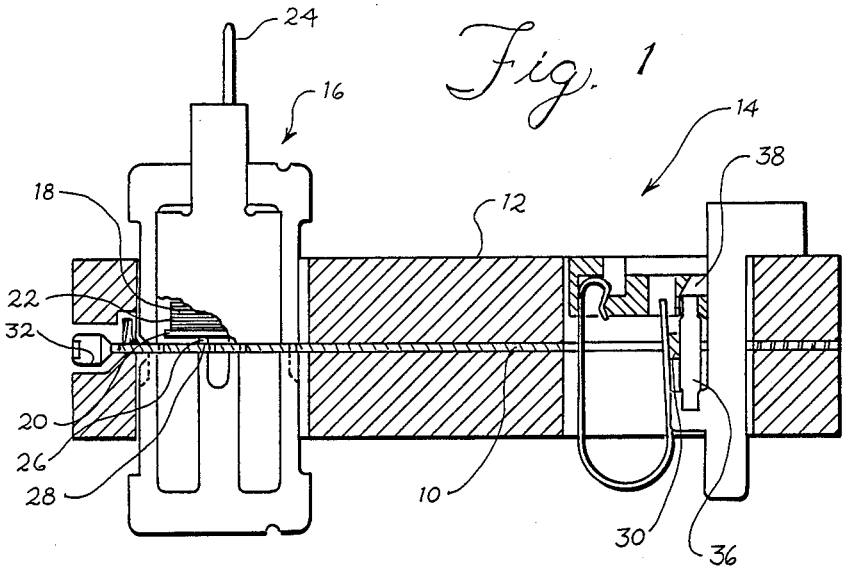

Referring to FIG. 1, slider 10 is mounted in frame 12 of print mechanism 14. Mounted on frame 12 is a stator assembly 16 comprised of a pair of coils 18 only one of which is shown in the figure. Each coil 18 has a bobbin 20 around which a copper wire 22 is wound. The wire is connected to pin 24 for attachment to a driver circuit not shown. Each coil 18 has a pair of stator teeth 26 vertically aligned with one another and forming a gap 28 occupied by slider 10. Slider 10 has tail end 30 and a face 32. Tail end 30 abuts dampener 36 mounted in dampener housing 38.

Figure 2:
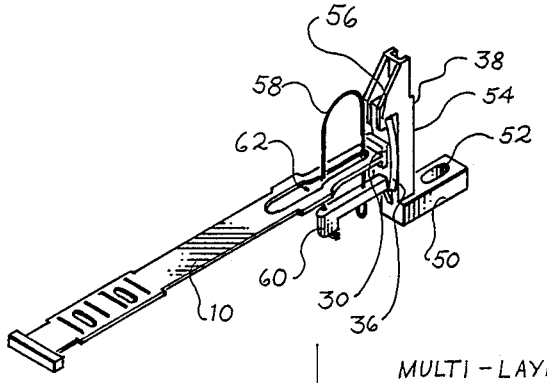
FIG. 2 shows the armature and dampener assembly of the present invention.
Figure 5:
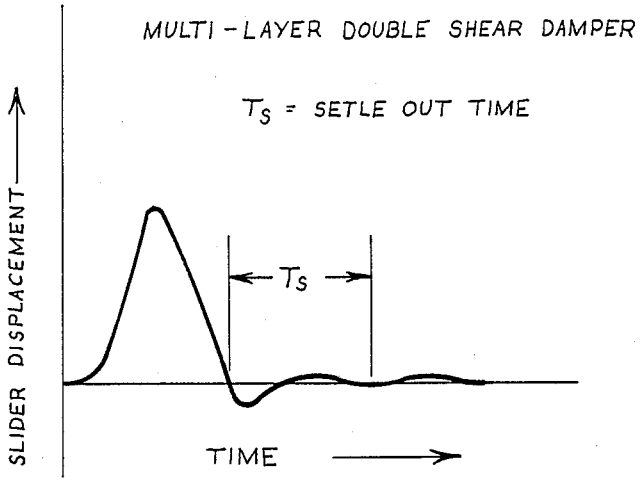
FIG. 5 is a graph of the armature position as a function of time.

Referring to FIG. 2, slider 10 is shown connected to dampener housing 38 in isolation. Dampener housing 38 has an L shaped mounting member constructed of nylon or other similar material. Shoulder 50 of housing 38 has mounting hole 52 for fastening to frame 12 with a nut and bolt, rivet or other suitable fastening means. Post 54 of housing 38 has brackets 56 for positioning and holding dampener 36. Return spring 58 is held in position by finger 60 of housing 38. Slider 10 has spring gap 62 through which is mounted spring 58. Spring 58 holds tail end 30 against dampener 36.

Figure 3:
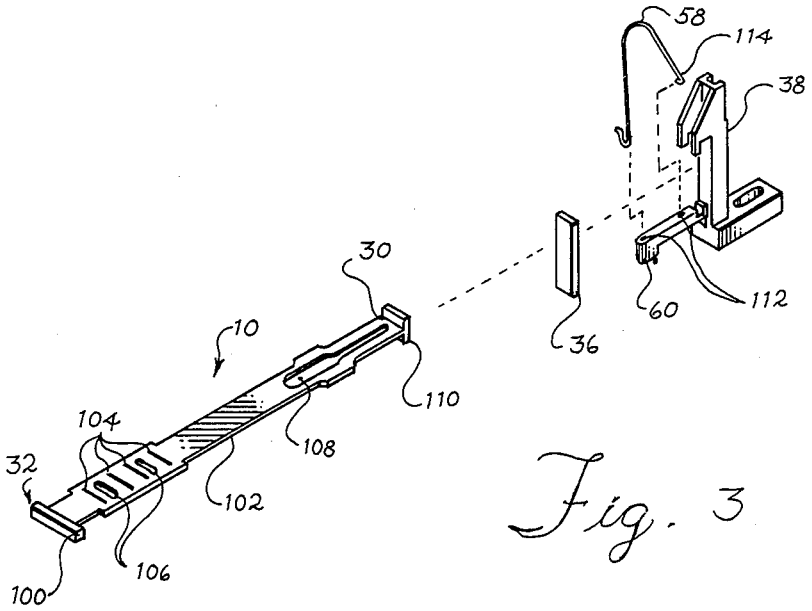
FIG. 3 is an exploded view of the armature/dampener assembly of FIG. 2.

Referring to FIG. 3., slider 10 is depicted in isolation showing hammer 100 with face 32. It is hammer 100 that impacts a print element which in turn drives a ribbon against a record medium such as paper to form a mark or character thereon. Body 102 of slider 10 is constructed preferably of an injection-molded plastic material. Behind hammer 100 are a plurality of armature elements 104 (illustratively four) formed of chemically etched electrical steel coated with titanium nitride. Openings 106 are also provided through body 102, for the purpose of reducing weight. Opening 108 is provided for receiving return spring 58. Tail 30 of slider 10 has impact surface 110 for contacting dampener 36. Hammer face 32 is constructed from stamped sheet metal in the preferred embodiment. Finger 60 of housing 38 has openings 112 for receiving ends 114 of spring 58.

Figure 4:
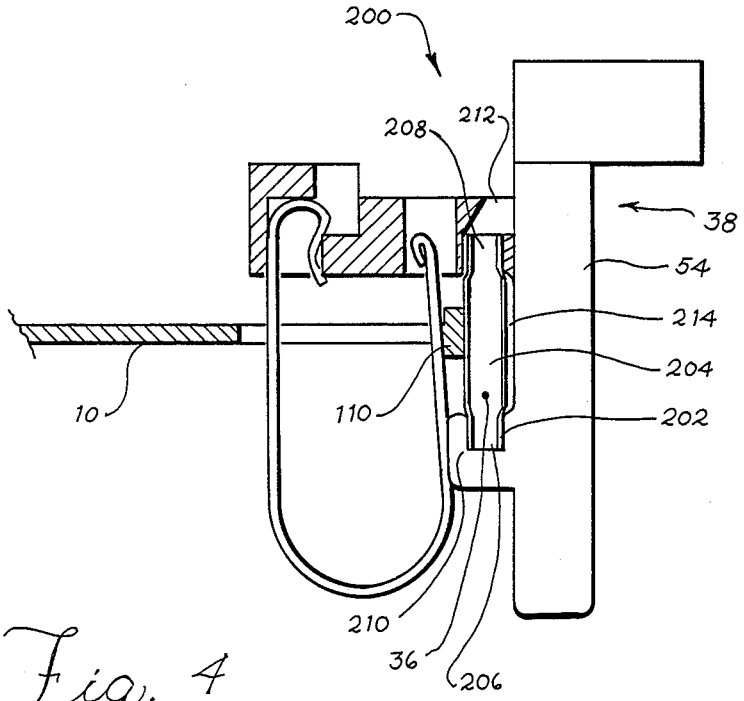
FIG. 4 is a side view of the dampener assembly showing the relationship between the dampener and the armature.

Referring to FIG. 4. a cross section of dampener module 200 shows the two layers of dampener 36. The outer two layers 202 are comprised of a relatively hard substance such as polyether polyurethane and inner layer 204 is comprised of a soft inner layer of 50 durometer butyl rubber. The three layers are held together with an adhesive such as 3M's 9458 acrylic adhesive film. The two ends 206 208 of dampener 36 are clamped in position by brackets 210. 212 of housing 38. post 54 of housing 38 is recessed from brackets 210. 212 to produce gap 214. A combination of the clamping action by brackets 210, 212 and the presence of gap 214 produces a shearing action in dampener 36 when struck by impact surface 110 of slider 10.

Figure 6:
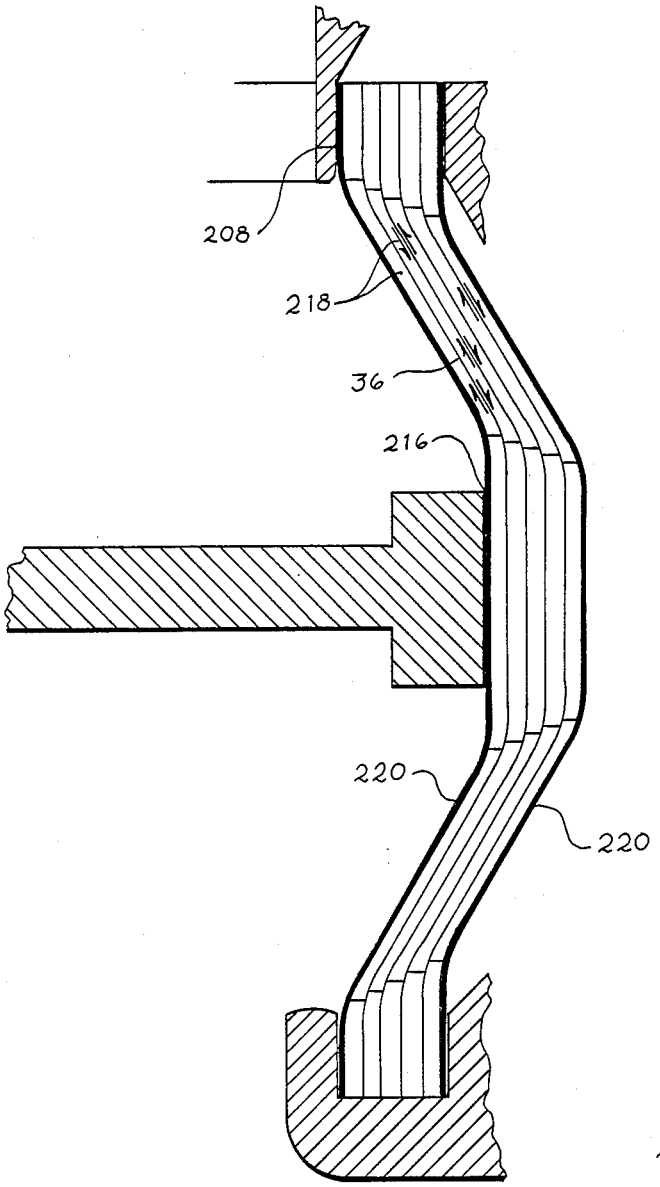
FIG. 6 is a schematic representation of shearing stresses in the dampener of the present invention.

Referring now to FIG. 6, a schematic representation of the shearing stresses in dampener 36 is provided. Dampener 36 is held in place by bracket 208 as impact surface 110 strikes face 216 of dampener 36 driving it into gap 214. As dampener 36 is driven into gap 214 the rubber fibers 218 tend to slide past one another as shown by the arrows. This sliding action creates shearing stresses which in rubber provide the best dampening characteristics. A hard outer coating 220, comprised of polyether polyurethane, is provided to protect the softer rubber fibers.

From the above description it will be seen by those having skill in the art that under the present invention, an electromagnetic linear actuator is provided having reduced settle-out time. This is accomplished by a three layer elastomeric dampener fixed in a frame so that kinetic energy of the actuator is dissipated through shear stresses of dampener. While the invention has been particularly shown and described with reference to a preferred embodiment. it will be understood by those skilled in the art that various other changes in form and detail may be made without departing from the spirit and scope of the invention.

We claim:

1. An electromagnetic actuator comprising:

an armature having a face and a tail:

a stator means having a core surrounded by a coil positioned adjacent to said armature for driving said armature in a forward direction when said coil is energized: and a dampening assembly positioned adjacent to said armature tail for absorbing kinetic energy of said armature, said assembly further comprising a frame member, a three layer dampener fixed in said frame member and adjacent to said armature tail so that contact by said armature places said dampener in shear whereby the kinetic energy of said armature is transferred to said dampening assembly.

2. The electromagnetic actuator of claim 1 wherein said three layer dampener has a thick inner layer and two thin outer layers.

3. The electromagnetic actuator of claim 2 herein said inner layer comprises an elastic material and said outer layers comprise an inelastic material.

4. The electromagnetic actuator of claim 3 wherein each of said outer layer is polyether polyurethane.

5. The electromagnetic actuator of claim 3 wherein said inner layer is butyl rubber.

6. The electromagnetic actuator of claim 3 wherein said inner and outer layers are held together with an adhesive.

* * * * *